US007637221B1

(12) United States Patent
Sinden

(10) Patent No.: US 7,637,221 B1
(45) Date of Patent: Dec. 29, 2009

(54) SAILBOAT

(76) Inventor: Frank W. Sinden, 120 Ridgeview Cir., Princeton, NJ (US) 08540

( * ) Notice: Subject to any disclaimer, the term of this patent is extended or adjusted under 35 U.S.C. 154(b) by 0 days.

(21) Appl. No.: 12/380,426

(22) Filed: Feb. 27, 2009

(51) Int. Cl.
*B63H 9/10* (2006.01)

(52) U.S. Cl. ..... 114/90; 114/39.24; 114/39.29; 114/39.32; 114/102.16

(58) Field of Classification Search ..... 114/39.24, 114/39.25, 39.26, 39.29, 39.32, 89, 90, 91, 114/97, 102.16, 102.2
See application file for complete search history.

(56) References Cited

U.S. PATENT DOCUMENTS

| | | | | | |
|---|---|---|---|---|---|
| 2,804,038 | A | | 8/1957 | Barkla | |
| 3,008,442 | A | * | 11/1961 | Russell, Jr. | 114/39.32 |
| 3,223,064 | A | | 12/1965 | White | |
| 3,802,366 | A | * | 4/1974 | Mankawich | 114/39.24 |
| 3,802,371 | A | | 4/1974 | Jastrab | 114/102 |
| 4,061,099 | A | | 12/1977 | Cook | 114/39 |
| 4,503,795 | A | | 3/1985 | Krans | 114/39 |
| 4,677,928 | A | | 7/1987 | Hoyt | 114/39 |
| 4,852,507 | A | * | 8/1989 | Ryon et al. | 114/39.26 |
| 4,911,093 | A | | 3/1990 | Estrup | 114/106 |
| 4,936,236 | A | | 6/1990 | Sinden | 114/39.1 |
| 4,945,845 | A | * | 8/1990 | Johnson, Jr. | 114/39.24 |
| 5,197,401 | A | * | 3/1993 | Finley et al. | 114/102.16 |
| 5,423,274 | A | | 6/1995 | Benze | 114/39.1 |
| 5,816,180 | A | * | 10/1998 | Hoyt | 114/89 |
| 2002/0139285 | A1 | | 10/2002 | Ward | 114/90 |

* cited by examiner

*Primary Examiner*—Lars A Olson
(74) *Attorney, Agent, or Firm*—Watov & Kipnes, P.C.; Kenneth Watov

(57) ABSTRACT

A sailboat has a preferably solid hull with lateral and longitudinal symmetry, a centrally located ring-shaped seat secured to a central portion of the top of an hull, a selectively rotatable carousel being mounted about an outer circumferential wall of said ring-shaped seat, a frame being secured to said carousel for retaining a pair of spaced apart identical sails that slant inward toward one another, a pair of removable selectively rotatable cylindrical booms being positioned on the frame with an associated halyard system for controllably furling and allowing easy reefing of the pair of sails, a pair of selectively removable rotatable hydrofoils each serving as a rudder and centerboard projecting downward from the bottom of and proximate the ends of the hull, a steering wheel being secured to the hull at the center of the ring-shaped seat and linked to each of the hydrofoils, whereby the carousel can be selectively rotated to position the sails at any desired angular position relative to the direction of the wind, without interfering with crew members who sit facing inward on the ring-shaped seat. Color-coded spaced-apart markings about a top circular portion of the carousel, relative to stripes applied to the top of the seat, show at a glance the angle of the frame to the seat, representative of the angle of the sails to the hull.

16 Claims, 11 Drawing Sheets

SAILBOAT

FIELD OF THE INVENTION

This invention relates to light sailboats suitable for use in protected waters.

BACKGROUND OF THE INVENTION

Because sailboats are subject to the caprice of the wind, they are less maneuverable than other boats. In particular, maneuverability is impaired by the awkwardness of coming about (turning from one diagonal upwind course, or tack, to the other). To come about, the sailor typically must: (1) push the tiller hard to lee, (2) switch the jib (if there is one), (3) duck the boom and (4) leap to the other side, all the while holding the tiller and mainsheet and keeping track of nearby boats or other obstacles. If the boat has too little momentum to coast completely around the turn, it ends up pointed into the wind with sails flapping in a position called "caught-in-irons" from which escape is awkward. Other, less drastic turns are also often difficult to execute quickly and accurately, especially in strong winds with the boat heeling (tipping away from the wind) and the crew hiked out (with their weight out to windward). Moreover, conventional sailboats cannot readily slow down or stop in a well-controlled way. This often makes landing at a dock or mooring under sail a difficult and uncertain maneuver.

An unusual type of sailboat (the proa), which has longitudinal but not lateral symmetry, solves some of these problems but poses others. The proa has a double-ended hull with an outrigger to windward on which the crew sits. The weight of the crew balances the heeling moment of the wind force on the sail. Like conventional sailboats, proas can tack upwind, but they come about in a different way. Instead of turning into the wind, they turn away from the wind, so that at mid-turn the wind is on the beam (perpendicular to the axis of the boat). At this point, the crew turns the sail to catch the wind on the other side, causing the proa to reverse direction. It then turns upwind on the new tack. Coming about in this way is called shunting. Shunting does not depend on momentum and thus avoids the risk of getting caught-in-irons. Proas can also come to a controlled stop with the wind on the beam, and then move off in either direction.

Offsetting these advantages of the proa is awkwardness in making downwind turns. A conventional sailboat moving before the wind can turn directly either way, provided care is taken to control a possible jibe, in which the boom swings across the cockpit. A proa can make the corresponding turn only by executing a complete shunt. If it turns directly, the outrigger can end up on the wrong side where, instead of counter-balancing heeling, it reinforces it.

Some sailboats of the prior art have elements that in some ways are similar to elements of the boat described here, but no combination of elements was found in the prior art that yields solutions to all of the maneuverability problems described above.

SUMMARY OF THE INVENTION

Basically described, the invention comprises a symmetrical two-ended boat bearing a ring-shaped seat on which the crew sits facing inward, with a rig (masts, sails, stays, etc.) mounted on a frame that can rotate like a carousel around the outside of the seat, preferably on rollers running in a slot in the seat's outer edge. All parts of the rig are well away from the crew. An advantage of this seating arrangement is that it makes conversation and socializing easy, thus enhancing the value of the boat as a pleasure craft. It also allows a person to stand or move about in a space free of overhead obstacles.

The two-ended hull can move either way through the water. A steering wheel or lever is located at the center of the ring-shaped seat with its axis parallel to the hull's longitudinal axis. It is linked to associated rudders in such a way that the boat always turns in the same direction as the top of the wheel or lever is moved, no matter which of the two ways the hull happens to be moving through the water. The two rudders (identical and located near the ends of the hull, preferably underneath) are linked to turn oppositely. Together, the two rudders are large enough (preferably about 4% of the sail area) to serve both the steering and centerboard functions.

Two identical sails are mounted on opposite sides of the carousel-frame with their feet (bottom edges) parallel. The sails can be thought of as analogous to the wings of a biplane, except that their vertical axes are not quite parallel, but are moderately slanted inward, so that the sails' heads (tops) are closer together than their feet.

Parallel sails (or wings) suffer unfavorable aerodynamic interference if they are too close together. To make this interference acceptably small, the sail separation needs to be substantially greater than the sail width.

The efficiency of a sail (or wing) depends on the aspect ratio (height divided by average width). Tall narrow sails are more efficient than short wide ones. But for a given sail area, a higher aspect ratio increases the heeling moment, which in turn increases the magnitude of the required counter-balancing ballast moment. This gives an advantage to two half-size parallel sails like those in the present invention. Comparison of a pair of widely separated identical sails with a single sail of the same aspect ratio and the same total area shows that (in a uniform wind) the pair of sails develops the same driving force as the single sail but with only about 70% of the heeling moment. (The exact fraction is one over the square root of two or 0.707.)

The heeling moment of the pair of sails is further reduced if the sails are slanted so that their heads are closer together than their feet. In this case the vector sum of the forces on the two sails is horizontal and lower than the centers of effort, so that the heeling moment arm is shortened. It is possible to slant the sails so much that the heeling moment vanishes altogether, but at practical separations such an extreme slant reduces the projected area of the sail so much as to make this possibility unattractive. ("Projected area" means the area of the projection of the sail onto the vertical plane through the sail's foot. The projected area is the effective area of the sail.) The preferred embodiment of the invention uses triangular sails with a moderate slant of about 20 degrees from vertical and a foot separation of about twice the foot length. This shortens the heeling moment arm significantly at the cost of an insignificant loss in driving force.

The sails roll up on horizontal, cylindrical booms, which can be readily removed from the boat and stored under cover to protect the sailcloth from long exposure to the sun. The unrolling of the sail is effected by a taut halyard that passes from the head of the sail up through a pulley at the top of the mast structure, then down to a pulley on the carousel frame and from there back to the cylinder on which the sail is rolled. As the sail unrolls, the halyard rolls up in such a way as to maintain a constant tension on the sail. This allows the sail area to be easily and conveniently reduced to any degree while the boat is under way. This, in combination with the symmetry features, permits the boat to approach and land at a dock or mooring as slowly and accurately as desired under wind power.

Since the novel sailboat described here has both lateral symmetry like a conventional sailboat and longitudinal symmetry like a proa, it can benefit from the advantages of both. It can come about either by turning upwind like a conventional sailboat or by shunting. Sometimes one way is more convenient, sometimes the other. In either case there is no boom to duck. Because of its relatively slight heeling, the sailboat of this invention can also make other turns more easily than most existing boats. It can also come to a controlled stop like a proa, and then move off in either direction.

Direct downwind turns are safer in the boat described here than in conventional sailboats because jibes are less dangerous. That is because, as explained below, the sails and other components of the rig are out of the way of the crew at all times.

The structure, detailed below, that holds up the sail and accepts the considerable load imposed by the sail tension is designed to minimize the weight aloft.

Sailing skill requires, among other things, accurately setting two angles: (1) the angle of the sail to the wind and (2) the angle of the hull to the sail. The inventive boat described herein helps the sailor with the first angle by providing an easily read wind vane mounted on the rig in a strategic location ahead of the sails. It helps with the second angle by providing color-coded marks on the frame that show at a glance the angle of the frame to the fixed seat, hence to the hull.

The invention may be more fully understood by reference to the following drawings.

BRIEF DESCRIPTION OF THE DRAWINGS

Preferred embodiments of the present invention are described below with reference to the drawings, in which like items are identified by the same reference designations, wherein.

DETAILED DESCRIPTION OF THE PREFERRED EMBODIMENTS OF THE INVENTION

Figure 1:
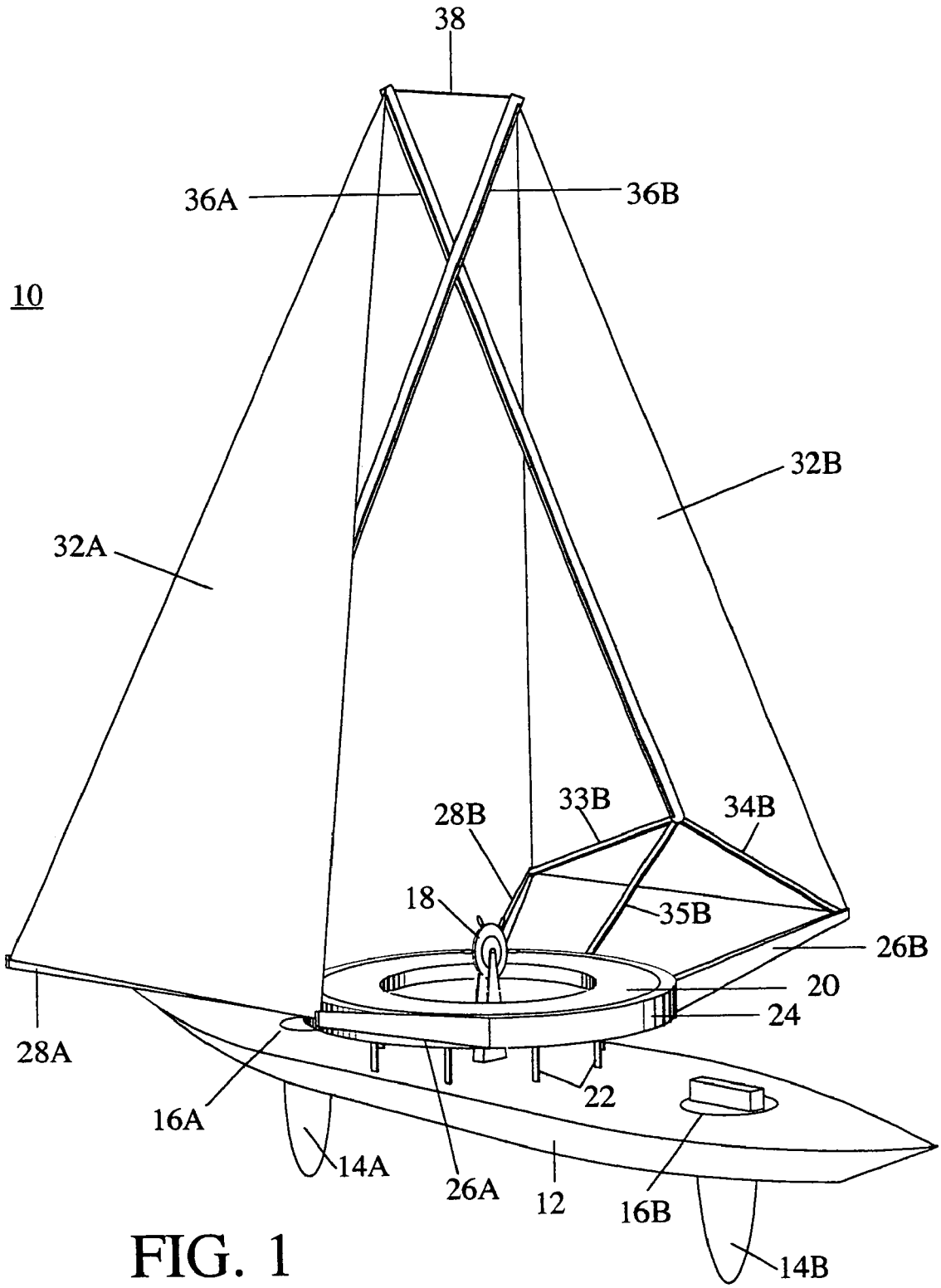
FIG. 1 is a simplified perspective view, with details omitted, of the present sailboat invention showing its main elements.

The general arrangement of the most basic elements of the novel sailboat 10 can best be seen in FIG. 1. The hull 12, which is both laterally and longitudinally symmetrical, can travel through the water in either direction. In the preferred embodiment, the hull has a flat solid shape, similar in construction to those used by surf sailors. Like surf-sail hulls it has no cockpit or other cavity that can catch and hold water. It differs from surf-sail hulls mainly in its full symmetry and its somewhat larger size. The flat bottom facilitates planning at high speed. The hull 12 can be made from fiberglass or any other suitable material.

Two vertical hydrofoils 14A, 14B, depending from the hull near the two ends, serve both as rudders and as centerboards. They are mounted in cylinders 16A, 16B, which are turned by a linkage connected to the steering wheel 18 at the center of the boat. (Wheel 18 is seen in more detail in FIGS. 5 and 11C) The linkage is discussed more fully in a later paragraph.

A ring-shaped seat 20 is fixed rigidly to the hull by means of a number of legs, of which representative ones are labeled 22. Crew and passengers sit on seat 20 facing inward. Surrounding seat 20 is a carousel-like frame 24 that is supported by rollers running in a slot (not visible in FIG. 1) around the periphery of the seat 20. Frame 24 comprises a rigid ring to which are attached four rigid arms 26A, 26B, 28A, 28B. The rollers permit the frame 24, hence the sails 32A, 32B, to be turned to any angular position with respect to the seat, hence with respect to the hull. Details of the roller system are discussed in a later paragraph.

Mounted on the ends of the four arms is a light but rigid structure that supports the two identical sails 32A and 32B. One half of the structure comprises the tripod struts 33B, 34B, 35B and the mast 36A together with stays (not shown in FIG. 1) along the three sides of sail 32B. The other, mirror image half (tripod struts 33A, 34A, 35A and mast 36B), is mostly obscured in FIG. 1 by sail 32A (see FIGS. 2, 5, and 6). Cable 38 joins the tops of the two crossed masts 36A, 36B.

Figure 6:
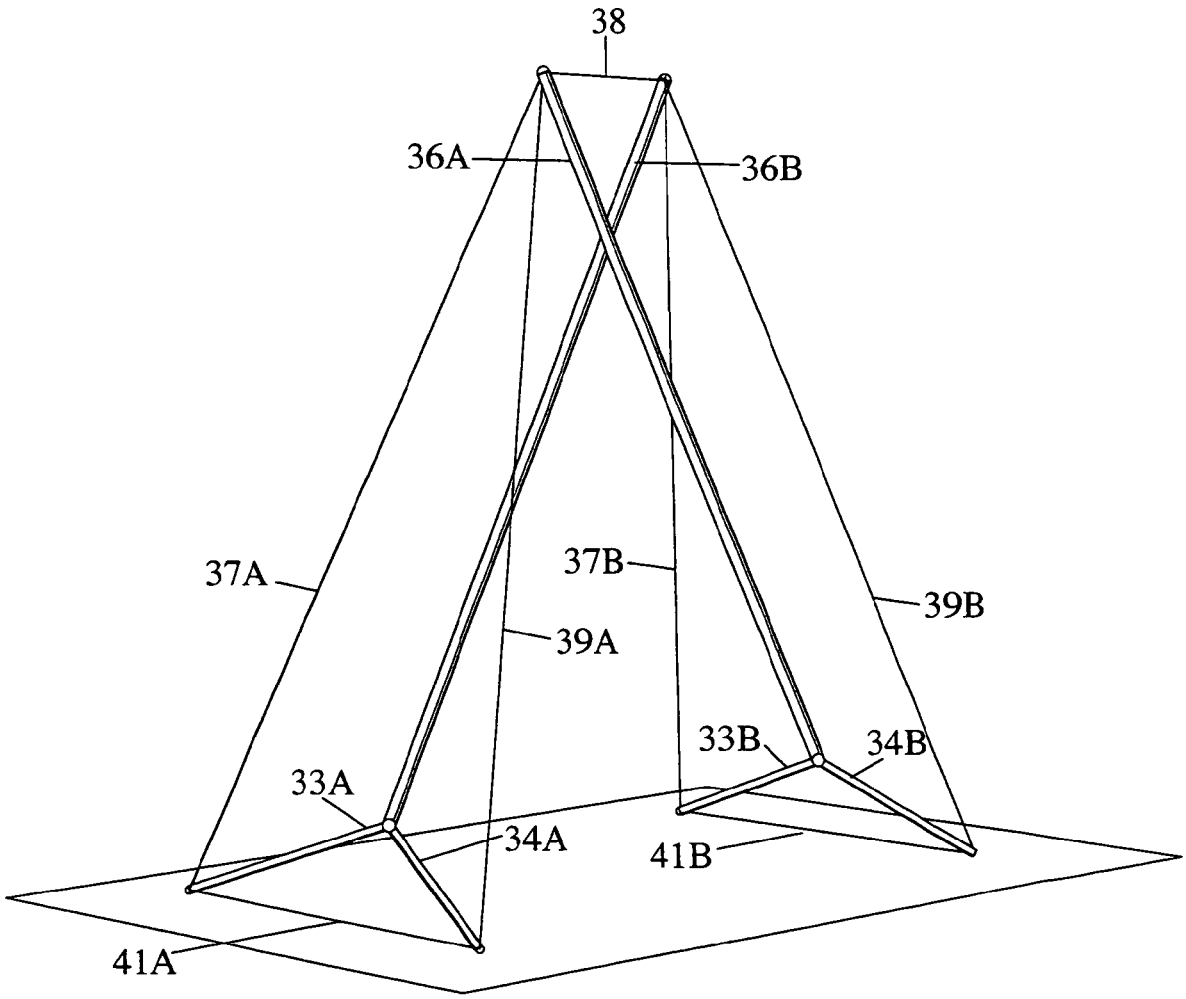
FIG. 6 is a diagrammatic perspective of the load-bearing members of the sail support structure.

By far the largest load imposed on this rigid structure is that from sail tension, which must be quite high to make the sails set properly. Within sails 32A, 32B most of this tension is taken by low stretch lines (not shown) sewn into the sails' luffs and leeches (leading and trailing edges). The support structure 33A, 34A, 35A, 36A, 33B, 34B, 35B, 36B is configured so that loads on it due to sail tension are taken mainly by the structure itself and not imposed on the carousel-frame 24. Because members 33B, 34B, 36A are coplanar, there is virtually no load on strut 35B, which serves only as a stabilizer. (A similar remark applies to strut 35A.) FIG. 6 shows just the load-bearing members of the structure. (For clarity, stays 37A, 39A, 41A and 37B, 39B, 41B are omitted from FIGS. 1, 2, 3.)

Figure 2:
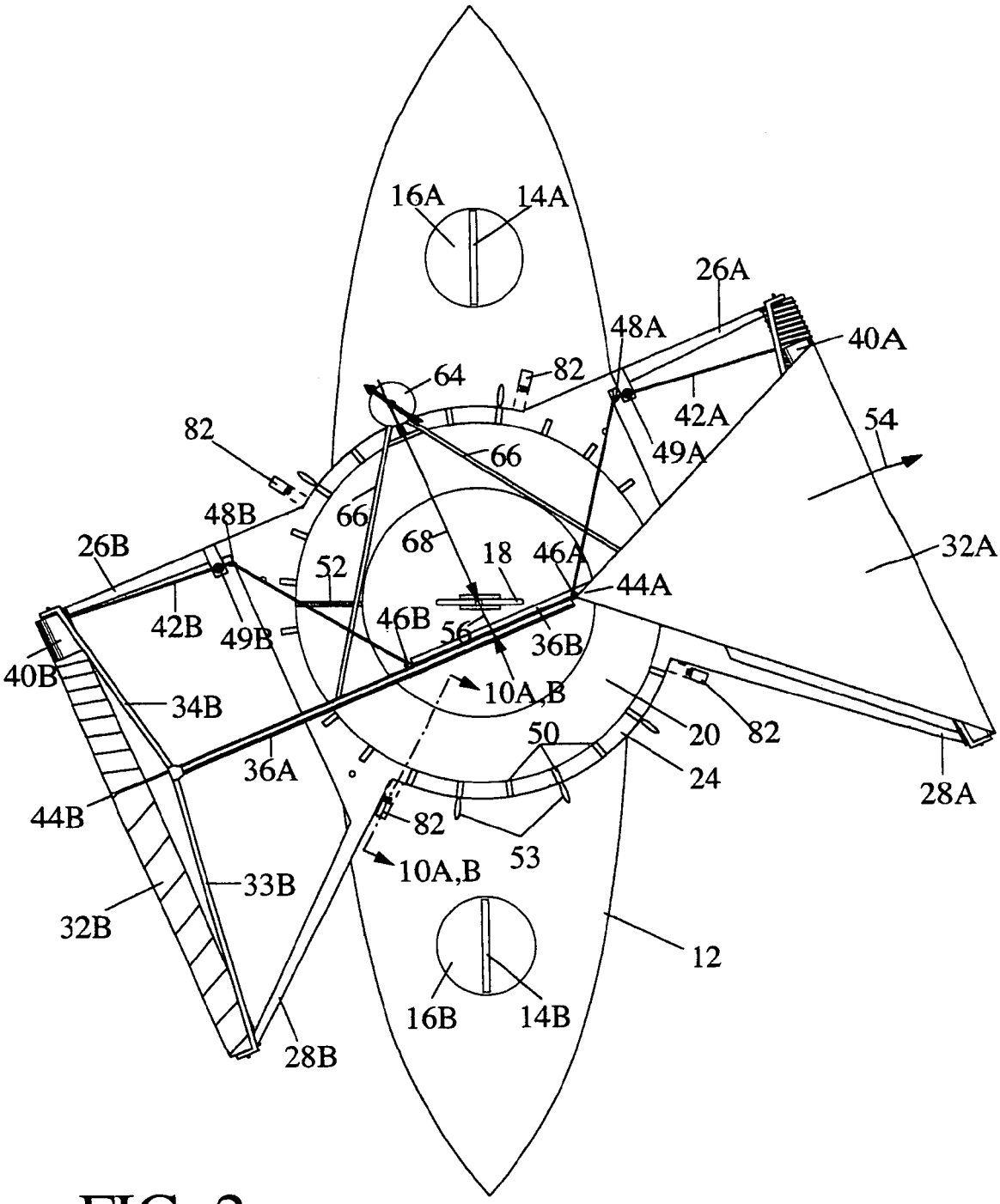
FIG. 2 is a top view, with details included, in which the carousel-like, rig-bearing frame is set at an angle suitable for an upwind tack.
Figure 3:
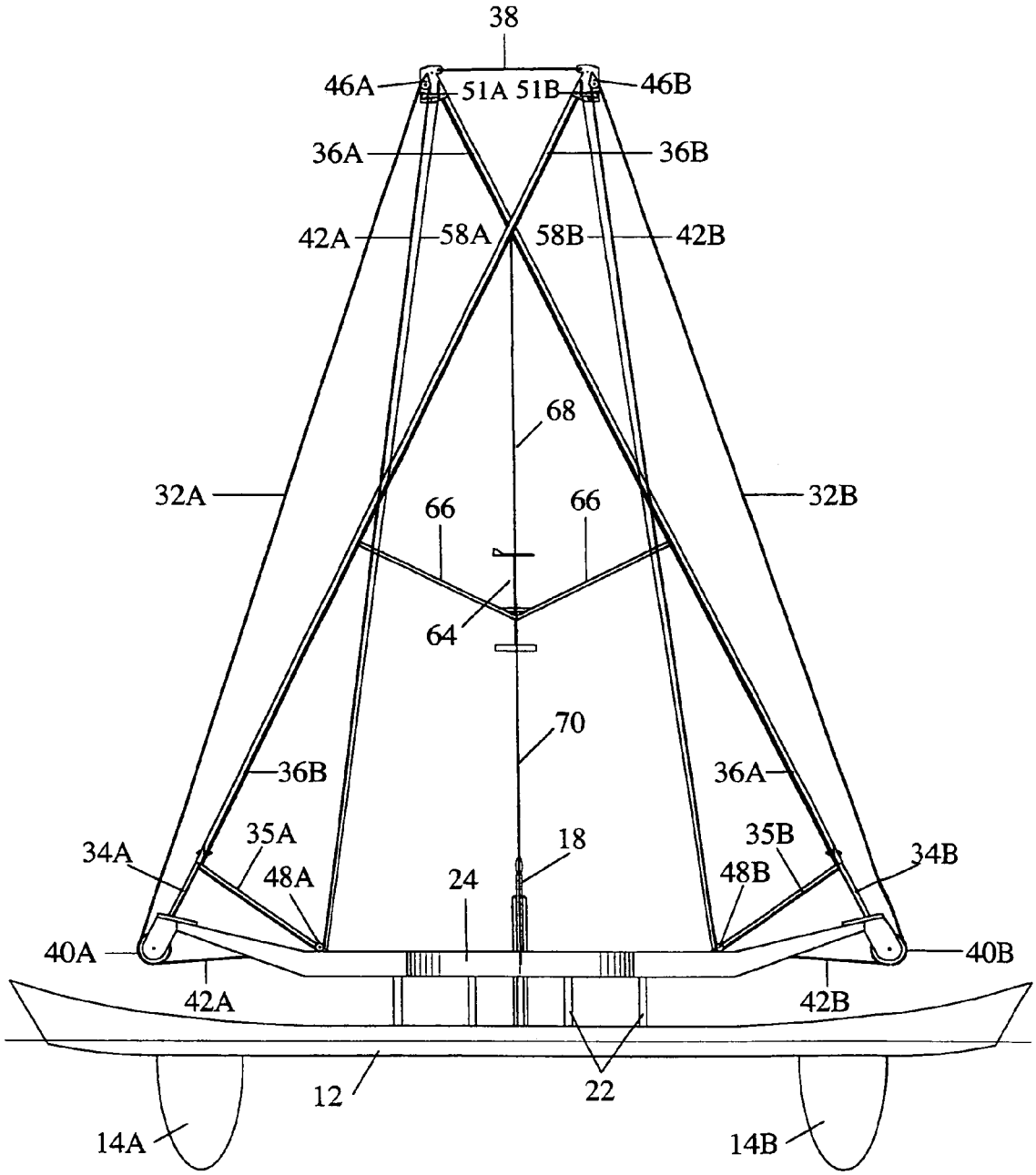
FIG. 3 is a side view with the line of sight perpendicular to the hull's longitudinal axis, and with the carousel-frame turned so that the line of sight is parallel to the sails.
Figure 4:
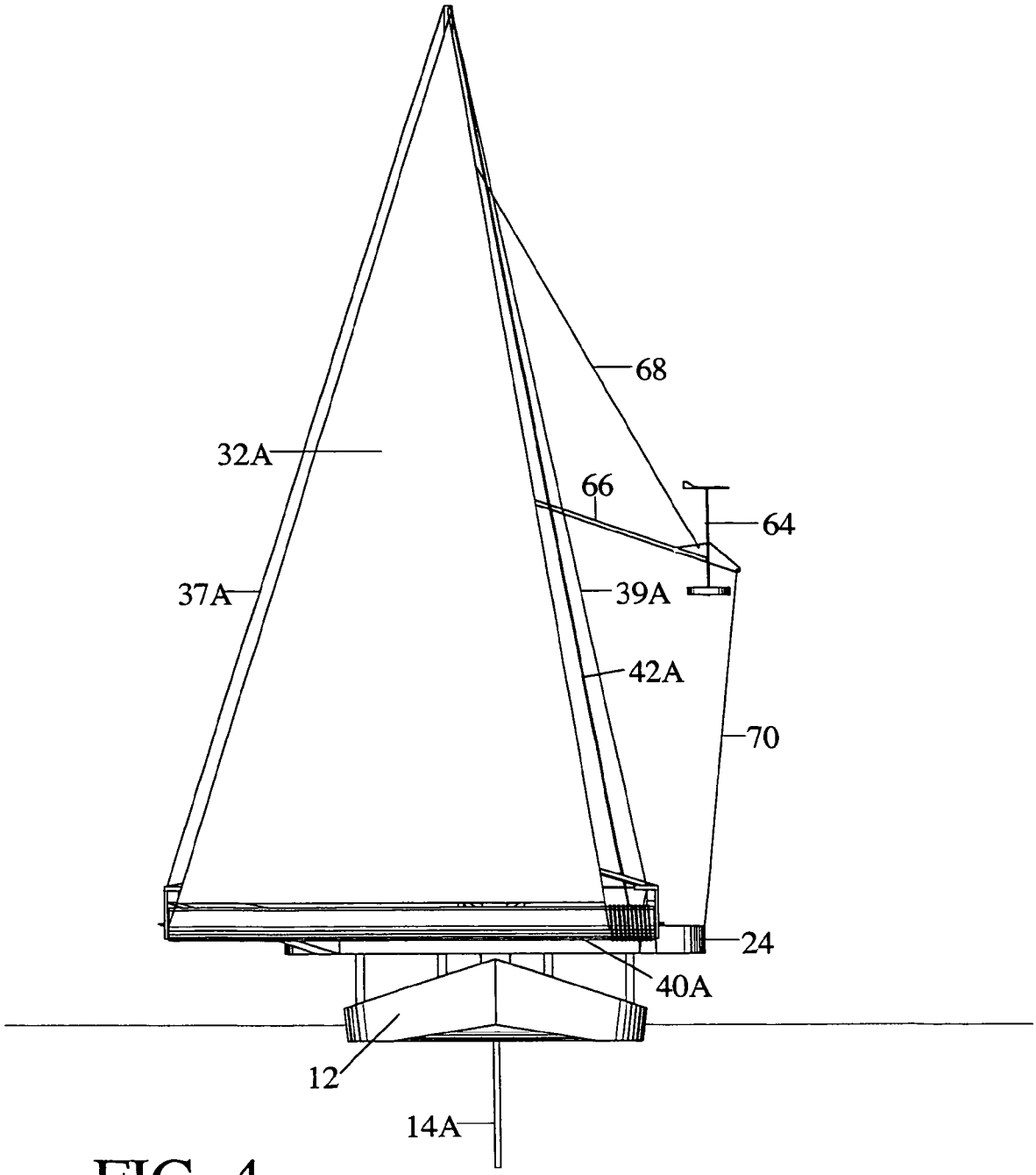
FIG. 4 is the same as FIG. 3, but with the line of sight parallel to the hull's longitudinal axis and perpendicular to the sails.
Figure 5:
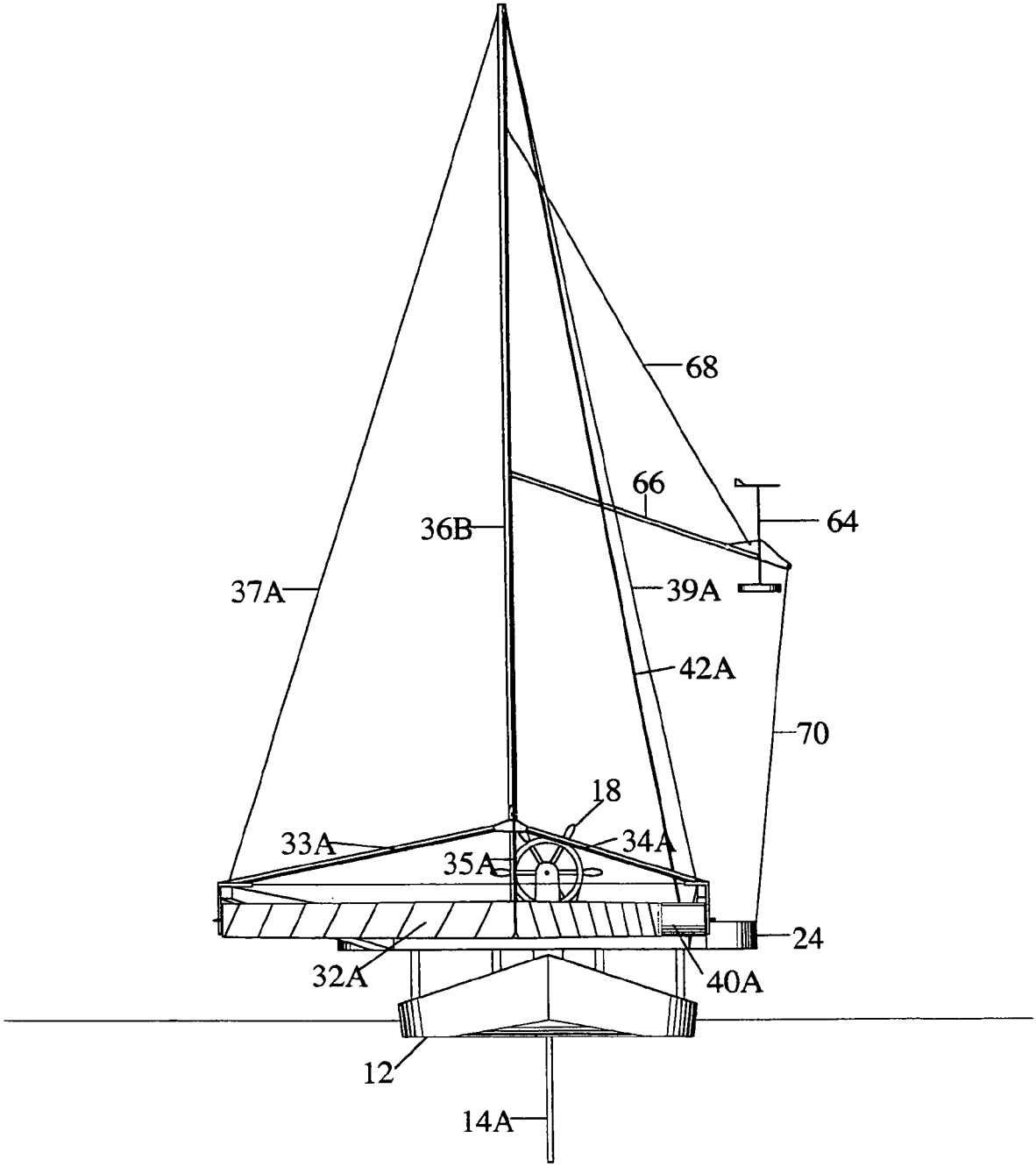
FIG. 5 is the same as FIG. 4 except that the sails are furled on the cylindrical booms.

FIG. 2 (top view) shows more detail than FIG. 1. Among the important features omitted for clarity from FIG. 1 but included in FIG. 2 are the cylindrical booms 40A and 40B on which the sails 32A, 32B, respectively, can be furled. The figure shows the left sail 32B furled and the right sail 32A raised. The sails 32A, 32B are raised and furled by means of halyards (ropes) 42A, 42B, respectively, which are also shown in FIGS. 3, 4 and 5. In FIG. 2 the halyard 42B can be seen to run from the head 44B of the furled sail 32B to a pulley 46B at the top of mast 36B, thence to pulley 48B on the frame 24 and finally to the roller boom 40B. As the sail is raised (by downward force on the halyard between pulleys 46B and 48B) the sail unwinds while the halyard winds up.

In FIG. 2 the right hand sail 32A is shown in the raised position. The right hand halyard 42A runs from sail head 44A over pulleys 46A and 48A to cylinder 40A. Since the sail 32A is completely unwound, the halyard 42A is completely wound as shown.

This and the following paragraphs give further detail about the system of halyards. For simplicity, just one of the two halyard systems will be described with the understanding that the other one works in exactly the same way. The end of boom 40A where halyard 42A winds up is preferably provided with a helical groove (not shown) to guide the rope so that it winds exactly the same way every time in a single layer. It is desirable for halyard 42A to maintain a constant tension during its entire travel. But to achieve this requires special attention. That is because the effective radius of cylinder 40A declines as sail 32A unwinds due to the declining thickness of the remaining layers of cloth. To compensate for the resulting tightening of halyard 42A, one could use a spring-loaded take-up, but a more elegant solution is to taper the end of cylinder 40A where halyard 42A winds up so that at every point of the travel the radius at the halyard exactly equals the radius at the sail. This simple system contributes substantially to the practicality of adjusting the sail area while under way.

Once the sail 32A is raised to a desired height, it must be put under substantial tension. This is done with the aid of cam cleats, (standard sailboat fittings that allow a rope to slide freely one way but clamp it tightly if it starts to move the other way.) One common kind of cam cleat (e.g. West Marine 4631594) has two positions for the rope: one in which the rope can move only one way, and one in which the rope can move either way. Cam cleat 49A, whose location is shown in FIG. 2 near pulley 48A, is of this kind. In the cleat mode, 49A constrains halyard 42A from rolling up on cylinder 40A, thus preventing sail 32A from unfurling further. Halyard 42A passes through a second cam cleat 51A (see FIG. 8) at the top of mast 36A just under pulley 46A. Cam cleat 51A constrains halyard 42A from moving upward, thereby constraining the head 44A of sail 32A from moving downward. The two cam cleats 49A and 51A acting together cause the sail to tighten under a downward force on halyard 42A.

Figure 8:
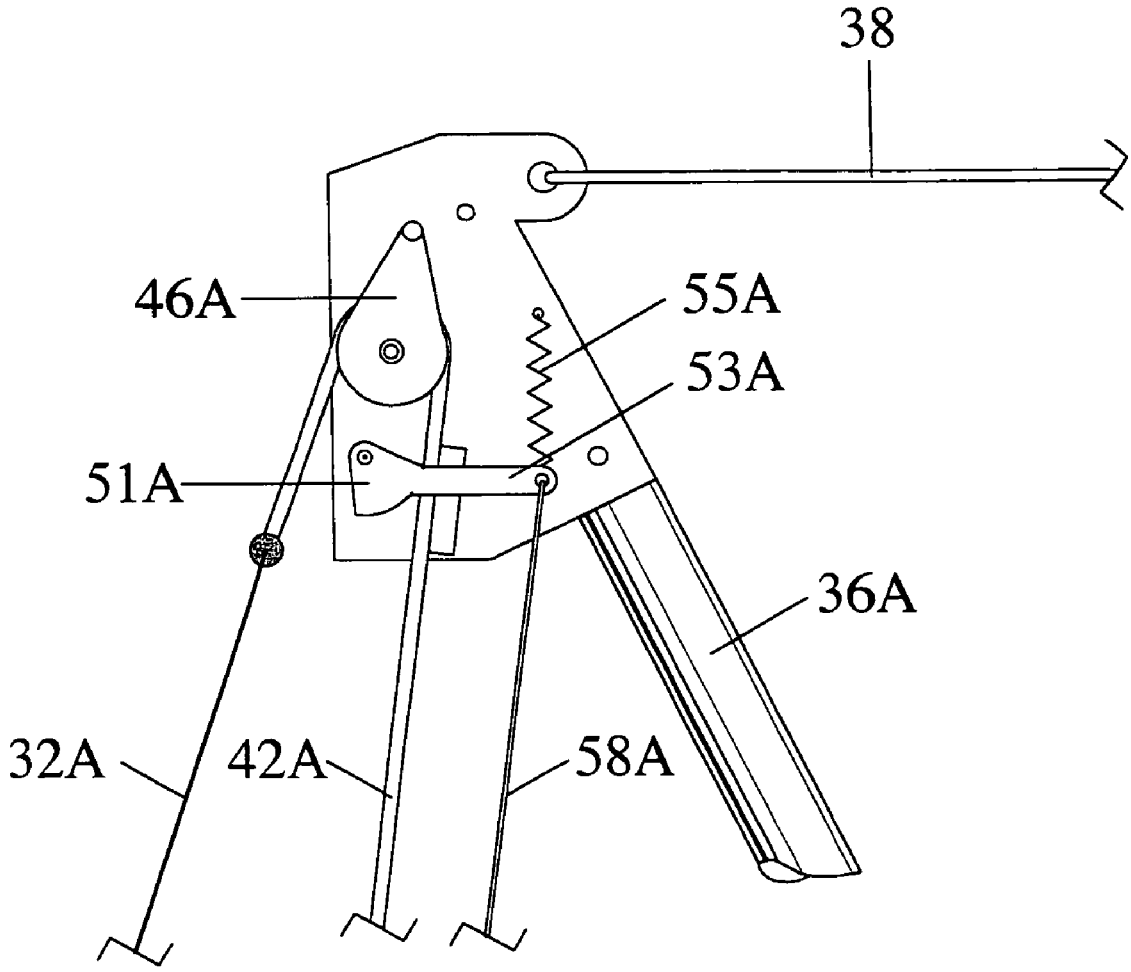
FIG. 8 shows a front elevational view of a device at the top of the mast for clamping and releasing the halyard.

Cam cleat 51A is modified from the standard version so that it can be released remotely from the deck. As shown in FIG. 8, it is provided with a release lever 53A, which, though urged upward by spring 55A, can be pulled downward by cord 58A, whose lower end is anchored near pulley 48A, as can be seen in FIG. 3. When cord 58A is pulled downward, cam cleat 51A is released so that halyard 42A can be moved upward to lower sail 32A. Note that the lower cam cleat 49A permits this motion even when in the cleat mode.

To raise sail 32A, the lower cam cleat 49A is put in the free movement mode and halyard 42A is pulled downward. Then to tighten the sail, the lower cam cleat 49A is set to the cleat mode and a strong downward force is applied to halyard 42A.

The two cam cleats 49A, 51A could both be located more conveniently at the bottom, but this would double the stress on the sail support structure. That is because the tension on the halyard would equal that on the sail and the structure would have to carry the loads of both. With one cam cleat at the top, the halyard can be relatively slack so that the load on the structure is essentially just that of the sail. Sail tension increases under wind pressure.

The large diameter of each of the cylindrical roller booms 40A, 40B serves two purposes: (1) to reduce the number of wraps of sail, facilitating neat wrapping of both sail and halyard, and (2) to provide flotation in a place where it can significantly resist capsizing.

Another feature shown in FIG. 2 but omitted from FIG. 1 is the set of twenty-two painted marks, of which those labeled 50 are representative. These are spaced 15 degrees apart around the periphery of the ring portion of the rotating frame 24, and are color-coded to tell the skipper at a glance the angle at which the sail frame 24 is set relative to the hull. To read the angle, the skipper looks at one of the two stripes 52 painted on the fixed seat 20 and observes the colors of the nearest marks 50. (In FIG. 2 only one of the stripes 52 is visible; the other, diametrically opposite stripe, is hidden by sail 32A.)

Figure 7:
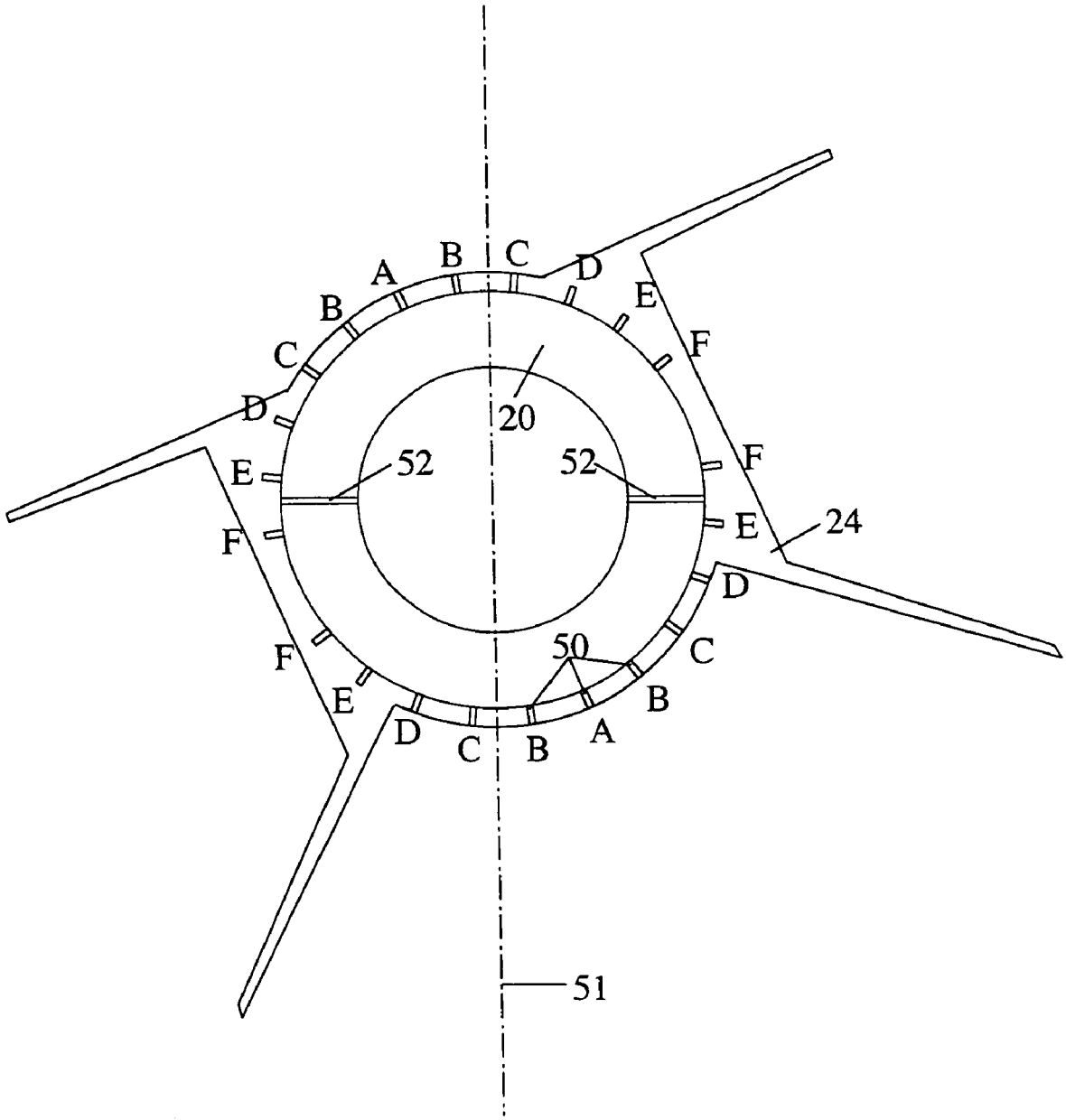
FIG. 7 is a top view of the seat and the carousel-frame showing color-coded markings.

FIG. 7 is a top view of the seat 20 and frame 24 with the colored marks 50 labeled with letters A through F to show the color pattern. Marks labeled with the same letter have the same color. Because of the symmetries of the frame 24 and hull 12, only six different colors are needed. The colors are arranged in such a way that both seat stripes 52 always give the same reading. The choice of colors is, of course, arbitrary, though there may be some advantage in choosing bright primary and secondary colors in rainbow order: A black; B blue; C green; D yellow; E orange; F red, for example. The color red, suggesting a warning, is appropriate for F, because in the ordinary course of sailing, frame 24 would never be set with stripes 52 between the Fs. In that range of positions the wind force is approximately perpendicular to the boat's longitudinal axis 51 and so develops a heeling moment but little or no propulsion. In making a controlled stop, frame 24 is turned so that stripes 52 are aligned with marks A.

In FIGS. 2 and 7, the frame 24 is set at an angle to the hull suitable for an upwind course with the apparent wind coming from the top left of the figure.

Frame 24 is turned and held in position by hand. FIG. 2 shows handles, represented by those labeled 53, that are spaced around the periphery of frame 24 so that some handle is always conveniently accessible to a person sitting at any location on seat 20. With relative dimensions as shown in FIG. 2, the handle force required to hold frame 24 in position is about one sixth of the force of the wind on the sails. If frame 24 is released, the wind tends to turn it so that sails 32A, 32B are feathered, i.e. so that the wind is parallel to the sails and its force on them is essentially zero.

The vector integral of the distributed wind forces on a sail is a single force vector, which (1) is approximately perpendicular to the plane of the sail and (2) passes through a point on the sail called the center of effort. In FIG. 2 this force vector is represented for sail 32A by arrow 54. If the line of arrow 54 (the line of force) is extended back in FIG. 2 toward the center of the boat, it will be seen to be aligned with masts 36A, 36B, and therefore to pass a short distance aft of the boat's center. The distance from the line of force to the boat center is labeled 56 and will be called offset 56. The strength of the wind's restoring moment, i.e. the moment that tends to feather the sails and the moment that must be resisted to hold frame 24 in a fixed position, is proportional to offset 56. The length of offset 56 can be built in to the design or can be made adjustable.

The exact location on a sail of the center of effort depends on many factors, including the angle of attack (the angle between the wind vector and the plane of the sail). By far the most important angle of attack for sailboat design is the one that maximizes the sail force, usually around 15 degrees. This is the angle of attack used on upwind courses, where efficiency is most critical. For an angle of attack of 15 degrees on a triangular sail, the center of effort, to a rough approximation, can be found by the immediately following geometric explanation: Consider a triangle of arbitrary shape with one vertex identified as the head and the opposite side as the foot. Let L denote the line that passes through the head and through that point on the foot that is 35% of the way along the foot from the luff to the leech. The center of effort lies approximately on line L about a third of the way up from the foot to the head.

For a sail of arbitrary shape, the fore and aft position of the center of effort would be expected to shift as the sail is furled on a boom, thus changing the arm length 56 of the wind's restoring moment. In the present invention, in which partially furled sails 32A, 32B are an important element, it is desirable to keep moment arm 56 constant, a condition that is satisfied if and only if line L is perpendicular to the sail's foot, as it is in sails 32A, 32B of the present invention. The requirement that line L be perpendicular to the foot accounts for the slanted luffs of sails 32A, 32B (See FIG. 4).

While the colored marks 50 aid the sailor in setting the angle of the sails 32A, 32B to the hull 12, wind direction indicator, 64 helps to set the angle of the sails to the wind. As shown in FIGS. 2, 3, 4 and 5, wind indicator 64 is supported by thin spars 66 and thin cables 68 and 70, which in turn are attached to the intersection of crossed masts 36A, 36B and frame 24. The resulting location of wind indicator 64 is (1) ahead of the sails 32A, 32B in undisturbed air, (2) low enough for the readout to be readily visible to the skipper without neck-craning and (3) high enough to be out of the way. Since wind indicator 64 turns with the rotating frame 24, it shows the angle of the wind relative to the sails.

Figure 9:
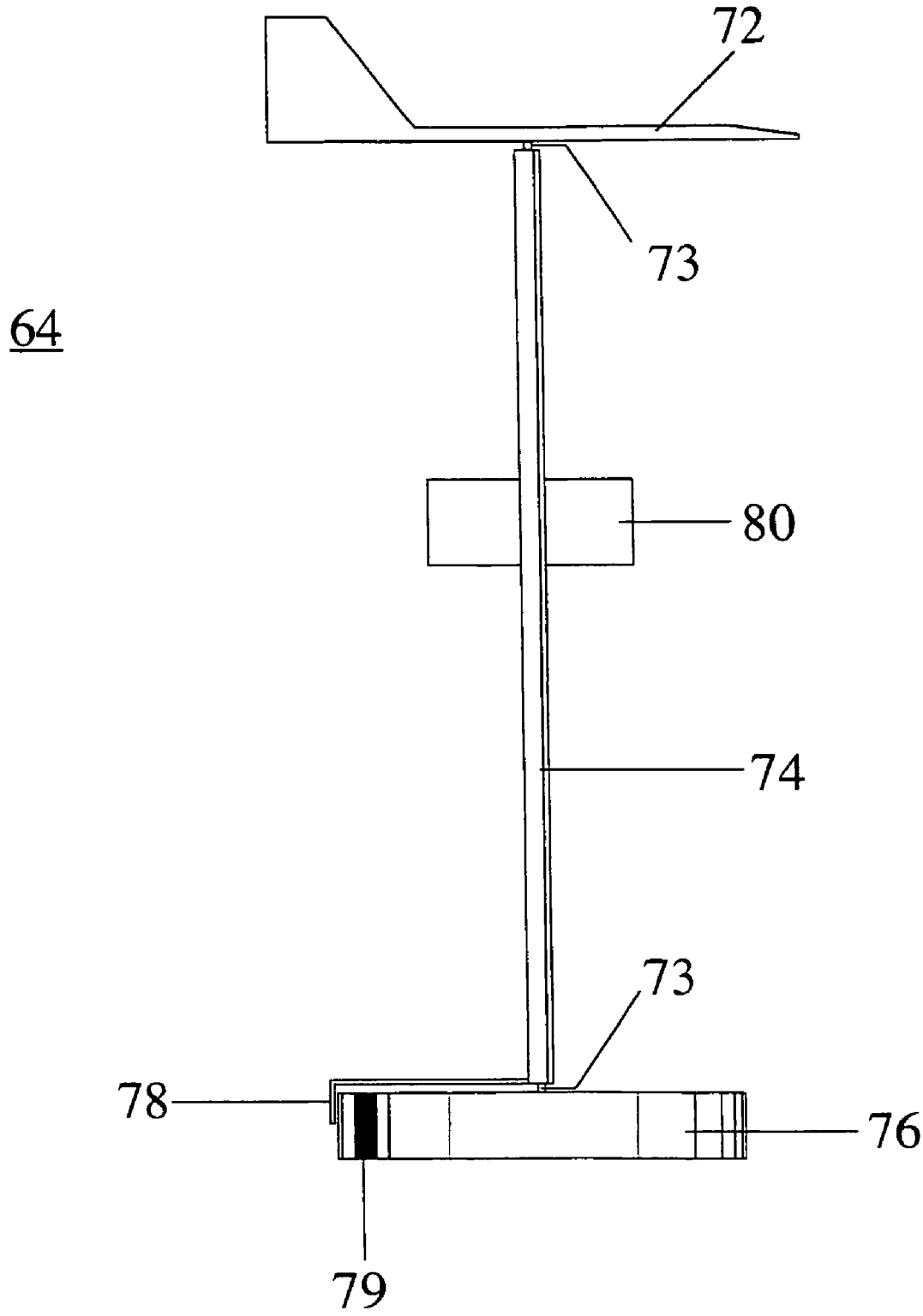
FIG. 9 shows a front elevational view of a removable wind direction indicator and its readout means.

Although wind indicators are standard devices, the present invention's application requires certain modifications. FIG. 9 shows the preferred design. Wind vane 72 and disk 76 are connected rigidly to a shaft 73 that runs through a tube 74. Marker 78, rigidly attached to tube 74, is aligned with the symmetry axis of the frame 24 (See FIG. 2). The disk 76 bears two diametrically opposing marks 79, 15 degrees to either side of the axis of wind vane 72, respectively. When the wind is such that either of the marks 79 is aligned with fixed marker 78, the wind force on the sails is maximal. Preferably one of the marks 79 is colored red to indicate that the wind is coming from the port side, and the other is colored green to indicate that the wind is coming from starboard. An additional mark in the center (between marks 79) would indicate that the sails are feathered and a mark diametrically opposite the center mark would indicate a jibe. For wind indicator 64 to work well, the disk 76 needs to be very light so that its moment of inertia does not materially exaggerate oscillations of the wind vane. Clip 80 allows the wind indicator to be readily attached to and removed from the boat.

The rollers that support the carousel-like frame 24 are mounted on four blocks 82 that slide into rectangular holes in the ring-shaped portion of frame 24 to engage the peripheral slot in the edge of seat 20. The locations of the four blocks 82 near the arms 26A, 26B, 28A, 28B are shown in FIG. 2, and greater details of this embodiment are given below relative to FIGS. 10A and 10B.

Figure 10A:
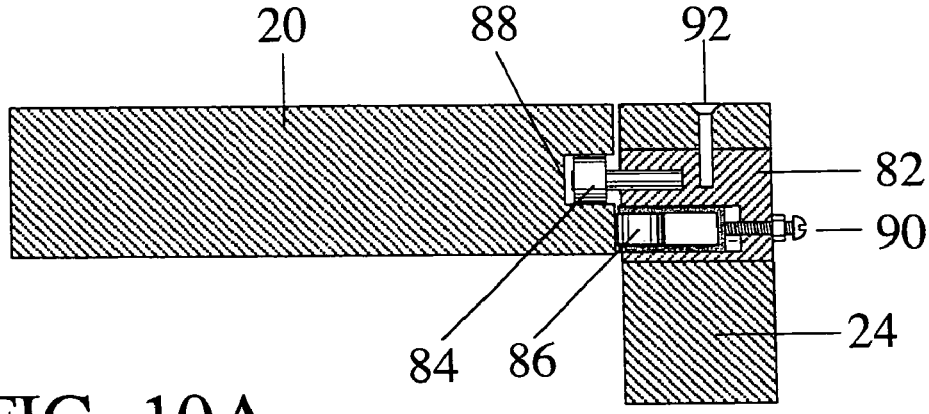
FIGS. 10A, and 10B show a partial cross-sectional view, and exploded assembly view, respectively, taken along 10AB-10AB of FIG. 2 for details of the rollers on which the carousel-frame rotates about a fixed seat.
Figure 10B:
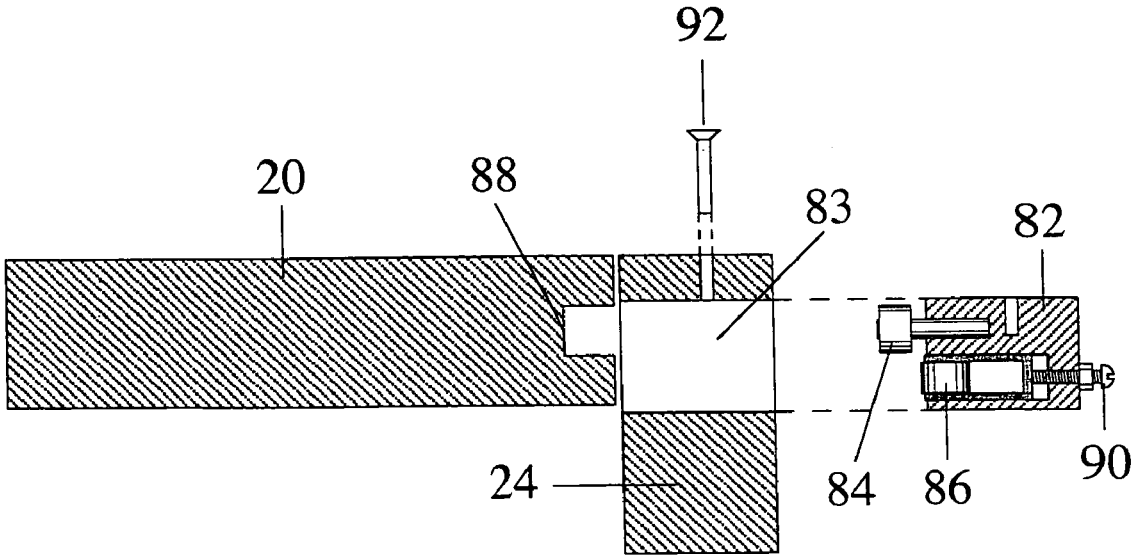

FIGS. 10A and 10B show a radial cross-section of the seat 20 and the frame 24 at a typical block 82 location. In FIG. 10A block 82 is in place with its rollers 84 and 86 engaged with the edge of seat 20. Roller 84, whose axis is radial, runs in circular slot 88 and constrains frame 24 from vertical displacement; roller 86, whose axis is vertical, runs on the rim of seat 20 and constrains frame 24 from radial displacement. Together the eight rollers 84, 86 constrain the frame to a single degree of freedom: rotation about the seat 20, i.e. about the vertical axis through the boat's center. Screw 90 allows fine adjustment of horizontal play. Pin, bolt or screw 92 fastens block 82 to frame 24.

FIG. 10B shows the roller block 82 removed from its hole 83 in frame 24. Removability of blocks 82 enables disassembly of frame 24 from seat 20. It also permits easy inspection or replacement of rollers 84, 86, which are preferably stainless steel ball bearings.

As noted above, the sailboat described here has two rudders 14A, 14B that serve both the centerboard and steering functions. The rudders 14A, 14B are located underneath the hull 12, where the flat bottom forms a ceiling bounding the water flow. It can be shown that the efficiency of such a bounded water foil is the same as that of an unbounded foil of twice the aspect ratio.

Figure 11A:
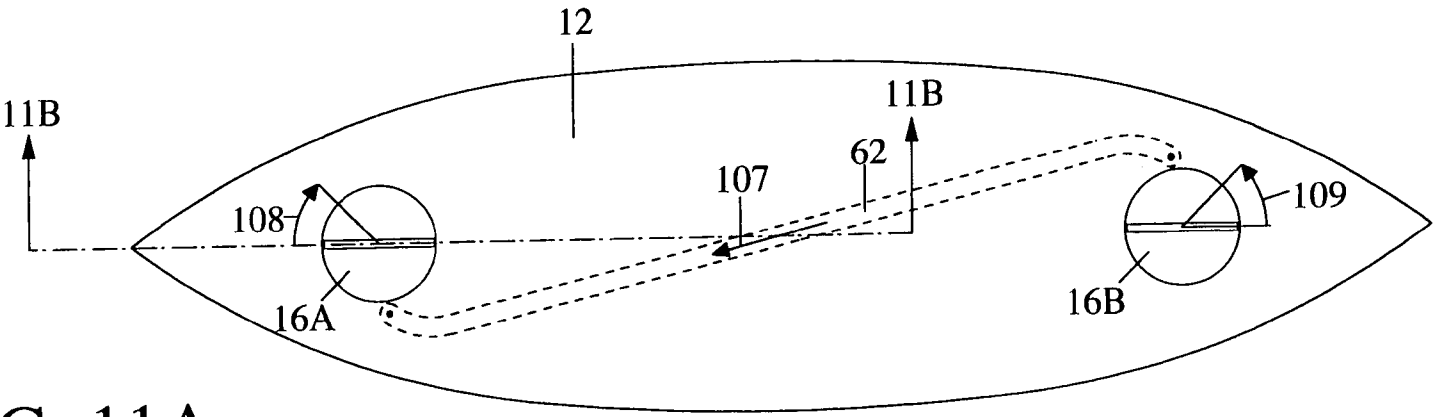
FIG. 11A is a top plan view of the deck with most components removed.
Figure 11B:
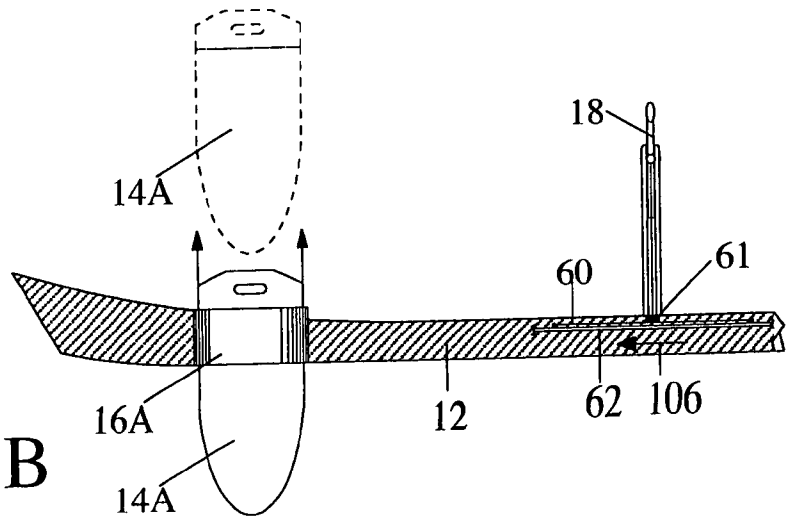
FIG. 11B shows a partial cross-sectional view taken along 11B-11B of FIG. 11A of a portion of the mechanical linkage from the steering wheel to the rudder cylinders, and how the rudders slide into slots in the rudder cylinders.
Figure 11C:
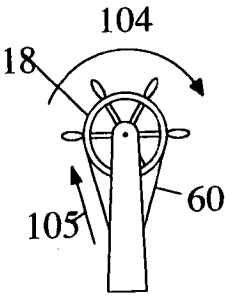
FIG. 11C is a front elevational view of the steering wheel mechanism of the present invention.

Rudders 14A, 14B are controlled by steering wheel 18 in such a way that rotation of the wheel 18 causes the rudders 14A, 14B to turn simultaneously in opposite senses. A linkage to accomplish this motion can be provided by standard steering cables. A simple, robust alternative linkage with potentially less friction is shown, in its main features, in FIGS. 11A, B, C. FIG. 11A is a plan view of the hull 12 showing parts of the linkage; FIG. 11B is a partial longitudinal cross-section of hull 12 taken where indicated in FIG. 11A; FIG. 11C shows wheel 18 and its pedestal turned 90 degrees from its position in FIG. 1/ B.

As shown in FIG. 11A, the two rudder-bearing, rotating cylinders 16A, 16B are linked by a stiff, diagonal connecting-rod 62, which lies just under the deck. Longitudinal movement of rod 62 turns cylinders 16A and 16B in opposite senses.

Cylinders 16A and 16B are mounted on rollers (not shown) that constrain their movement to rotation about their vertical axes. Since the rollers can be arranged in any number of equally good ways that would be well-known or obvious to anyone skilled in the art, they are not shown in FIGS. 11A, B, C.

A flexible line 60 passing around, and fastened to wheel 18 (FIG. 11C) drives connecting rod 62 back and forth. As can be seen in FIG. 11B, the two ends of line 60 are redirected in opposite horizontal directions by pulleys 61. They then run a suitable distance along connecting rod 62 before attaching to it. A sequence of arrows 104 through 109 shows the effect of turning wheel 18 clockwise. In FIG. 11A the arrows show that the effect is to turn cylinder 16A clockwise and cylinder 16B counterclockwise.

As shown in FIG. 11B, rudder 14A slides into a slot in cylinder 16A. This arrangement makes it easy to remove the rudders so that the boat can be pulled up on a beach or dock.

While the invention has been described with reference to the preferred embodiment thereof, it will be appreciated by those of ordinary skill in the art that modifications can be made to the structure and elements of the invention without departing from the spirit and scope of the invention as a whole.

What I claim is:

1. A sailboat comprising:

a hull having both lateral and longitudinal symmetry, first and second ends, a top, and a bottom;

a ring shaped seat rigidly secured to a center portion of the top of said hull, for permitting crew and/or passengers to sit thereon facing inwards;

first and second sails;

a carousel frame rotatably mounted about circumferential sidewalls of said seat; and a rigid frame structure secured to said carousel frame for supporting said first and second sails in spaced apart opposition to one another, thereby permitting said carousel frame to be rotated for positioning said first and second sails to a desired position relative to the direction of the wind, without interfering with or requiring said crew and/or passengers to change their position on said seat.

2. The sailboat of claim 1, further including:

first and second selectively rotatable vertical hydrofoils proximate said first and second ends of said hull, and projecting downward from the bottom thereof, said hydrofoils each serving as both a rudder and centerboard.

3. The sailboat of claim 1, wherein said first and second sails are identical in shape.

4. The sailboat of claim 3, wherein said frame structure is configured to provide that wind pressure tends to rotate said carousel frame to position said first and second sails to a neutral position in which they are feathered, in the absence of a force restraining said carousel frame from so rotating.

5. The sailboat of claim 3, wherein said frame structure is configured to provide for said first and second sails to be slanted with their heads closer together than their feet, for reducing a heeling moment, but with said sails spaced far enough apart to minimize aerodynamic interference.

6. The sailboat of claim 1, wherein said frame structure is further configured to provide for said first and second sails to be slanted with their heads closer together than their feet, for reducing a heeling moment, but with said sails spaced far enough apart to minimize aerodynamic interference.

7. The sailboat of claim 1, further including:

first and second selectively rotatable cylindrical booms being removably mounted on said frame structure in association with said first and second sails, respectively; and a plurality of halyards for connecting said first and second sails to said first and second booms, respectively, and to said frame structure, for permitting said sails to be furled or unfurled to the extent desired relative to their respective boom.

8. The sailboat of claim 7, wherein said first and second sails are each triangularly shaped to provide that a center of effort is the same at fore and aft locations, respectively, for every degree of furling said sails, thereby insuring that for each sail an offset of the sail force relative to a center of rotation of said carousel frame remains the same when the respective sail's exposed area is reduced by partial furling.

9. The sailboat of claim 8, further including:

first and second reels individually integral with said first and second booms, respectively;

a plurality of pulleys mounted on said frame structure;

one of said plurality of halyards running from the head of an associated one of said first and second sails over individual ones of said plurality of pulleys, to an associated one of said first and second reels, to provide for furling and unfurling the associated sail; and said first and second reels each being shaped to insure the maintenance of constant tension on their associated halyard throughout its travel.

10. The sailboat of claim 9, further including:

first and second pairs of cam cleats associated with each one of said first and second sails, respectively;

one cleat of one of said pairs of cam cleats being secured to said frame structure proximate a top of its associated sail, the other cleat of said one of said pairs of cam cleats being secured to the said frame structure proximate a bottom of its associated sail, said one and the other cleats providing for selectively securing their associated halyard to tension their associated sail, or releasing their associated halyard to further furl or unfurl the associated sail.

11. The sailboat of claim 10, wherein said rigid frame supports a tension load from both sails without imparting any significant portion of that load to the carousel frame or other parts of the boat, and comprises:

a first mast having a top end and a bottom end;

a first pair of struts, which, by their compression, transmit a tension load of a first sail from the ends of said first boom to the bottom end of said first mast, which is coplanar with said pair of struts, and which first mast by its compression, transmits the tension load from its bottom end to its top end, the top end being connected to the head of said second sail;

a second mast having a top end and a bottom end;

a second pair of struts, symmetrically situated with respect to said first pair of struts, which transmit the tension load from the ends of said second boom to the bottom end of said second mast, which is coplanar with said second pair of struts, and which transmits the tension load to its top end, which is connected to the head of said first sail;

a stay connecting the tops of the two masts;

a first set of three stays connecting the bottoms of said first pair of struts and the top end of said second mast in a triangular configuration; and a second set of three stays connecting the bottoms of said second pair of struts and the top end of said first mast in a triangular configuration.

12. The sailboat of claim 11, further including:

a wind indicator;

a pair of spars each having one end connected individually to a central portion of one of said first and second masts, respectively, and another end connected rigidly to said wind indicator;

a fourth cable connected between said wind indicator and an upper portion of the associated one of said first and second masts; and a fifth cable connected between said wind indicator and said rigid frame structure;

said wind indicator being positioned to insure that it does not interfere with the raising and lowering of said first and second masts.

13. The sailboat of claim 12, further including:

a plurality of color coded markings equally spaced about the periphery of the carousel frame; and a pair of diametrically opposed markings applied on the top of said ring shaped seat proximate its circumferential edge;

the combination of said color coded markings and one of said pair of diametrically opposed markings permitting a skipper of said sailboat to tell at a glance the angle at which said carousel frame is set relative to said hull at any given time, for setting the positioning of said sails to the wind.

14. The sailboat of claim 2, further including:

a wheel;

a linkage shaft having one end pivotally connected to a top circular portion of said first hydrofoil, and another end pivotally connected to a top circular portion of said second hydrofoil at a position thereon that is 180 degrees displaced from the relative position of said one end as connected to said first hydrofoil, whereby movement of said linkage shaft causes said first and second hydrofoils to rotate in opposite directions; and a flexible line connected between said wheel and said linkage shaft, whereby rotation of said wheel causes movement of said linkage shaft for positioning said first and second hydrofoils to steer said sailboat.

15. The sailboat of claim 1, wherein said rigid frame supports a tension load from both sails without imparting any significant portion of that load to the carousel frame or other parts of the boat, and comprises:

a first mast having a top end and a bottom end;

a first pair of struts, which, by their compression, transmit the tension load of a first sail from the ends of said first boom to the bottom end of said first mast, which is coplanar with said pair of struts, and which first mast by its compression, transmits the tension load from its bottom end to its top end, the top end being connected to the head of said second sail;

a second mast having a top end and a bottom end;

a second pair of struts, symmetrically situated with respect to said first pair of struts, which transmit the tension load from the ends of said second boom to the bottom end of said second mast, which is coplanar with said second pair of struts, and which transmits the tension load to its top end, which is connected to the head of said first sail;

a stay connecting the tops of the two masts;

is a first set of three stays connecting the bottoms of said first pair of struts and the top end of said second mast in a triangular configuration; and a second set of three stays connecting the bottoms of said second pair of struts and the top end of said first mast in a triangular configuration.

16. The sailboat of claim 1, further including:

a plurality of color coded markings equally spaced about the periphery of the carousel frame; and a pair of diametrically opposed markings applied on the top of said ring shaped seat proximate its circumferential edge;

the combination of said color coded markings and one of said pair of diametrically opposed markings permitting a skipper of said sailboat to tell at a glance the angle at which said carousel frame is set relative to said hull at any given time, for setting the positioning of said sails to the prevailing wind.

* * * * *